US005316456A

United States Patent [19]

Eckhardt

[11] Patent Number: 5,316,456

[45] Date of Patent: May 31, 1994

[54] SLIDE VANE MACHINE

[76] Inventor: Georg W. Eckhardt, Karlstrasse 38, D-7990 Friedrichshafen 1, Fed. Rep. of Germany

[21] Appl. No.: 860,501

[22] PCT Filed: Dec. 18, 1990

[86] PCT No.: PCT/DE90/00971

§ 371 Date: Jun. 11, 1992

§ 102(e) Date: Jun. 11, 1992

[87] PCT Pub. No.: WO91/10812

PCT Pub. Date: Jul. 25, 1991

[30] Foreign Application Priority Data

Jan. 12, 1990 [DE] Fed. Rep. of Germany ..... 4000762
Sep. 15, 1990 [DE] Fed. Rep. of Germany ..... 4029345

[51] Int. Cl.[5] ..... F03C 2/00

[52] U.S. Cl. ..... 418/150; 418/255

[58] Field of Search ..... 418/150, 255

[56] References Cited

U.S. PATENT DOCUMENTS

| | | | |
|---|---|---|---|
| 1,994,245 | 3/1935 | Gette et al. | 418/98 |
| 2,071,258 | 2/1937 | Haydock et al. | 418/138 |
| 4,385,873 | 5/1983 | Richter | 418/23 |
| 4,449,899 | 5/1984 | Smolinski | 418/225 |

FOREIGN PATENT DOCUMENTS

| | | |
|---|---|---|
| 0264778 | 10/1987 | European Pat. Off. . |
| 167194 | 8/1904 | Fed. Rep. of Germany . |
| 2235045 | 7/1972 | Fed. Rep. of Germany . |
| 2407293 | 2/1974 | Fed. Rep. of Germany . |
| 2521190 | 5/1975 | Fed. Rep. of Germany . |
| 3616579 | 5/1986 | Fed. Rep. of Germany . |
| 826534 | 12/1936 | France . |
| 46761 | 4/1963 | German Democratic Rep. . |
| 209718 | 7/1940 | Switzerland . |
| 264819 | 6/1927 | United Kingdom . |

*Primary Examiner*—Richard A. Bertsch
*Assistant Examiner*—Charles G. Freay
*Attorney, Agent, or Firm*—Robert W. Becker & Associates

[57] ABSTRACT

A rotary slide vane machine has a housing with the inner contour of a Pascalian screw. The rotary piston is a hollow circular cylinder with an axis of rotation within the zero point M' of the Pascalian coordinates. The control shaft with eccentric segments is arranged inside the piston and has an axis of rotation within the center M of the Pascalian base circle. Slide vanes of a length L are guided within grooves of the rotary piston. Bearing bushings are rotatably guided on the eccentric segments and having flanges connected to the wings of the vanes. The length L is $6D+2r_{8s}+2d_{61}+2e+2s$ (D is the diameter of the base circle, $r_{8s}$ the radius of the eccentric segments, $d_{61}$ the wall thickness of the bearing sleeves, e the minimal displacement of the wing, and s the minimal distance between bearing sleeve and machine parts moving thereto). The flange contour is limited by an arc having the minimal distance s to the inner mantle surface of the rotary piston and by distance $S'E'_{min}$ of a wing to an inner edge E' of neighboring wings and by an arc with the radius $r_{Kb}$ minus the minimal distance s.

1 Claim, 10 Drawing Sheets y
x
E 90°
E 45°
E 0°
E 270°
E 315°
180°
21
S
P
E
M'
M
O
K
K'
r'
r
1/2 l
l
w
w'
S(x2r y0)
P(x2r y0)
(xry0)

Y
X
Kb
E'90°
E'45°
E'
112,5°
135°
157,5°
180°
0°
E'
D + r8s + d61 + s
K'
M'
M
MKb
K
E''90°
E''180°
E''157,5°
E''112,5°
E''135°
E'225°
E'270°
rKb
r8s + d61 + s
D = r'
D
d61 + s + r8s
rKb

NE max
dKr
s
d6l
l6Fl
h6Fl
D8
s
d6l
NE max
dKr
1
E
E'
4
6f
5
E'min
180°
s180/3°
s180/5°
Kb
8
8s
16
9
M
M'
K
P
90°
y
E'
270°
x
E0°
2
2
6f
E'max
N
5
6s
6Fl
4
1
E
E'
D
e
s
D
r8s
d6l
s
d6l
r8s
D
D
D
D
e
s
D
D
D
D $$S'E'_{min} = M'E'_{180°} \cdot \sin\beta - (1/2\, d_{6f} \cdot \cos\beta + 1/2\, d_{6f} + s)$$

SLIDE VANE MACHINE

BACKGROUND OF THE INVENTION

The present invention relates to a slide vane machine based on the geometric principle of the conchoidal of the circle, also called Pascalian Screw, with one or multiple slide vanes per working chamber in which shape and proportions of the rotating machine parts are adjusted and optimized relative to one another based on a calculation method.

Slide vane machines of the aforementioned kind are known from the U.S. Pat. Nos. 1,994,245 and DD 46,761 and have the following constructive design:

As shown in FIG. 5, in a hollow cylinder 1 with an inner contour E corresponding to the circumferential line of the Pascalian Screw which is closed off on both ends by housing end plates a rotary piston 4 in the form of a hollow circular cylinder is supported in both housing end plates in a rotatable manner and axially oriented relative to the hollow cylinder. The axis of rotation of the rotary piston corresponds to the center M' of the central circle K' of the Pascalian Screw represented in drawings 1 and 2. From this it results that the rotary piston with the radius $r_{Kr}$ with its outer surface approaches the inner surface of the hollow cylinder at the approximation point $21(-xr_{Kr}Yo)=E180°$ to form a narrow slot.

The control shaft 8, embodied as a crankshaft, with the radius r of the base circle K is guided through the hollow rotary piston and through central openings in its end faces and is also rotatably supported within the two housing end plates, whereby the crankshaft axis corresponds to the center M of the base circle K, the crankshaft axis being arranged parallel to the axis of the rotary piston.

On the crankshaft pins of the control shaft one or two slide vanes 6 with their half length L/2 are rotatably supported. They correspond functionally to slide vane wing pairs 6*f* staggered by 180° which are connected to form a rigid slide vane by stays 6*s* connected to one or two central bearing sleeves 61. Their center P corresponds to the axis of the crankshaft pins, and during the rotation of the control shaft, they follow the base circle K. The slide vanes are additionally guided in diametrically opposed longitudinal grooves 5 of the rotary piston In machines with one slide vane per working chamber the masses due to inertia of the crankshaft pins revolving on the base circle K and of the slide vane must be compensated by two counterweights at the control shaft.

The use of more than one slide vane per working chamber allows for the compensation of the forces of inertia without counterweights, when the slide vanes have a longitudinal and transverse axial symmetry and the bifurcation of the stays 6*s* is arranged with the bearing sleeve 61 is arranged such that they do not overlap one another.

Since the axis of rotation of the rotary piston is at $M'_{(xo\,yo)}=P_{(xo\,yo)}$, the central circle K' contacts the base circle K at $P_{(x2r\,yo)}=S_{(x2r\,yo)}$, r' corresponds to 2r, and the points P and S have the same trajectory velocity and direction of rotation, the central outer toothing of the control shaft 8 with the partial circle $K_t$ may engage a central inner toothing (see, for example, the representation of FIG. 9) within one rotary piston end face with the partial circle $K_t'$.

The ratio of the number of teeth of the outer toothing 10 to the number of teeth of the inner toothing 11 is 1:2. The toothing engagement of the control shaft with the rotary piston ensures the exact synchronous rotation of these two machine parts at the ratio 2:1 and compensates bending forces acting on the slide vanes.

The machine geometry according to the Pascalian Screw also allows for constructions without toothing engagement of the control shaft 8 with the rotary piston 4, because the course of movement of the slide vanes effects a force-controlled rotation of the rotary piston and the control shaft in the aforementioned ratio 1:2.

However, due to the torque acting on the control shaft, an additional bending moment acts on the slide vanes. The bending of the slide vanes may lead to canting within the longitudinal grooves 5.

When synchronously rotating control shaft and rotary piston, the mass points of the slide vanes which are centrally located on the axis within the point P move with the number of revolutions of the control shaft along the base circle K with simultaneous rotation of the slide vanes about their axis in the point P with the number of revolutions of the rotary piston (see FIG. 5). The rounded side edges 22 of the slide vanes follow the circumferential line E of the Pascalian Screw and may thus be guided contact-free along the inner surface of the hollow cylinder 1 with the same contour.

Simultaneously, the slide vanes perform a periodic pushing movement relative to the rotary piston side wall which per revolution in each direction reaches once the maximum displacement $NE_{max}=2D$ at the position 0°.

In the patent DD 46 761 a mounting of only one slide vane per working chamber for a working principle which differs from the object of the present invention is disclosed.

The gas outflow takes place via channels within the rotary piston and the desired high inner compression is accomplished by employing the rotary piston 4 as the slide vane valve.

In the text and in the drawings the control shaft 8 is represented as a crankshaft. The problem of the design and lubrication of the slide vane bearing is not addressed.

In the text and the drawings of U.S. Pat. No. 1,994,245, the control shaft is also represented as a crankshaft with a lubricant channel that is guided through the crankshaft pins and the webs.

The constructive principle upon which the above invention is based discloses only the use of two slide vanes per working chamber. The slide vanes are comprised of two halves which are divided at the respective bearing.

The aforementioned prior art devices have the following disadvantages:

The control shaft is in the form of a crankshaft. Accordingly, the slide vanes are provided with the greatest possible constructive space within the rotary piston; however, the crankshaft concept has the following severe disadvantages:

Due to the low eccentricity the crankshaft may be manufactured in a divided form with known screw and plug-in connections which allow the use of undivided needle bearings only under high expenditures with a strongly reduced bending and torsional stiffness. Accordingly, as already suggested in U.S. Pat. No.

1,994,245, the control shaft is thus embodied as a undivided crankshaft with a lubricant channel within the crankshaft pins and webs. The slide vanes must then be provided with divided friction bearings.

However, with this embodiment a new problem arises: The boring of the lubricant channel. Due to the manufacturing technology it must be assembled from a plurality of partial borings extending through the crankshaft, the crankshaft pin, and the crankshaft webs. Due to the low eccentricity of the control shaft the through boring of the crankshaft pin for a higher number of slide vanes is very difficult.

The control shaft, due to the machine geometry, may be supported with its ends only once at the housing end plates. This results, for a greater constructive length which is unavoidable when using a greater number of slide vanes and which, due to the favorable shape of the slide vane machine, is also desirable, in the embodiment as a crankshaft to a reduced bending and torsion stiffness because of the smaller crankshaft pin cross-sections.

Accordingly, the load capacity of the control shaft and the precision of the slot between the slide vane side edges 22 and the hollow cylinder inner surface area is lowered parallel to a respective reduction of the efficiency.

The available area for the positioning of the slide vane bearings on the control shaft is twofold reduced with the embodiment as a crankshaft:

Due to the smaller diameter of the crankshaft pin the bearing diameters are small.

The maximum total width of the bearing is determined by the control shaft section within the hollow cylinder. With an increasing number of slide vanes the bearing width that is available for the individual slide vane is thus reduced. It is further reduced due to the necessary formation of the crankshaft webs.

The aforementioned disadvantages may be avoided when the control shaft is embodied as an eccentric shaft:

The manufacture as a divided shaft is substantially simpler. As can be seen from drawing FIG. 5, the individual eccentric segments 8*s* with a respective angular staggering are positioned on a continuous central guide shaft 9. The slide vanes may also be provided with undivided needle bearings.

The lubricant channel may be embodied as a central longitudinal slotted boring 16 from which extend radial bores within the control shaft eccentrics to the slide vane bearings.

In addition to the production-technological advantages a functional advantage in the form of an increase in the lubricant pressure due to the centrifugal acceleration within the radial eccentric borings is achieved.

The bending and torsional stiffness is increased due to the axially overlapping eccentric segments 8*s*.

The diameter and the width of the slide vane bearings are greater.

In the embodiment as an eccentric shaft the control shaft cross-section is greater and, accordingly, the rotary piston diameter $D_{Kr}$ for a constant maximum displacement $NE_{max}$ is also increased.

The technical applicability is thus limited because with an increasing diameter of the control shaft the ratio of the maximum displacement $NE_{max}$ the rotary piston diameter $D_{Kr}$ and thus the specific displacement volume is reduced. The displacement of the proportion of L and $D_{Kr}$ to $NE_{max}$ is represented in drawing FIG. 3.

Simultaneously, the toothing diameter of the control shaft in relation to the slide vane length is reduced. The smaller toothing is loaded by an increased torque.

A further disadvantage of the prior art is the low number of slide vanes per working chamber:

In analogy to the working principle of the multi-cellular machine a number of slide vanes as high as possible per working chamber should be realized in order to accomplish comparable pulsation and inner compression values.

FIG. 9 shows an exemplary embodiment of a slide vane machine according to the principles of the present invention. The housing 1 has end walls 2, 3 in which a rotary piston in the form of a hollow circular cylinder 4 is rotatably supported by bearings 15. A control shaft 8 with sections 8*s* is connected to a central guide shaft 9 and is supported in bearings 13 within the end walls 2, 3. The outer toothing 10 of the control shaft 8 cooperates with the inner toothing 11 of the rotary piston 4. The slide vanes are wing pairs 6*f* that are connected via a center stay 6*g* with central bearing sleeves 61 for supporting the slide vane bearings 14 to form a fixed slide vane.

Slide vane machines with one or two slide vanes are technically of no importance because of pulsation values that are too great and achievable maximum inner compression rates that are too low.

The slide vane machine of the aforementioned U.S. patent within the represented proportion of $D_{Kr}$ to $NE_{max}$ and the design with two slide vanes per working chamber may not be expanded to a greater number.

From the prior art it may not be deduced whether the construction principle may be expanded to a number of slide vanes comparable to multi-cellular machines because of the additionally required constructive space for the use of an eccentric shaft.

It is therefore an object of the present invention to realize the embodiment of the control shaft as an eccentric shaft while simultaneously employing a greater number of slide vanes per working chamber with the aid of a calculation method or rule for slide vane machines of the aforementioned kind and, on the other hand, to determine the shape and proportionality of control shaft with the outer toothing 10, slide vanes, and rotary piston with the inner toothing 11 with optimal use of the constructive space such that the maximum displacement $NE_{max}$ reaches the greatest ratio possible with respect to the diameter $D_{Kr}$ of the rotary piston.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
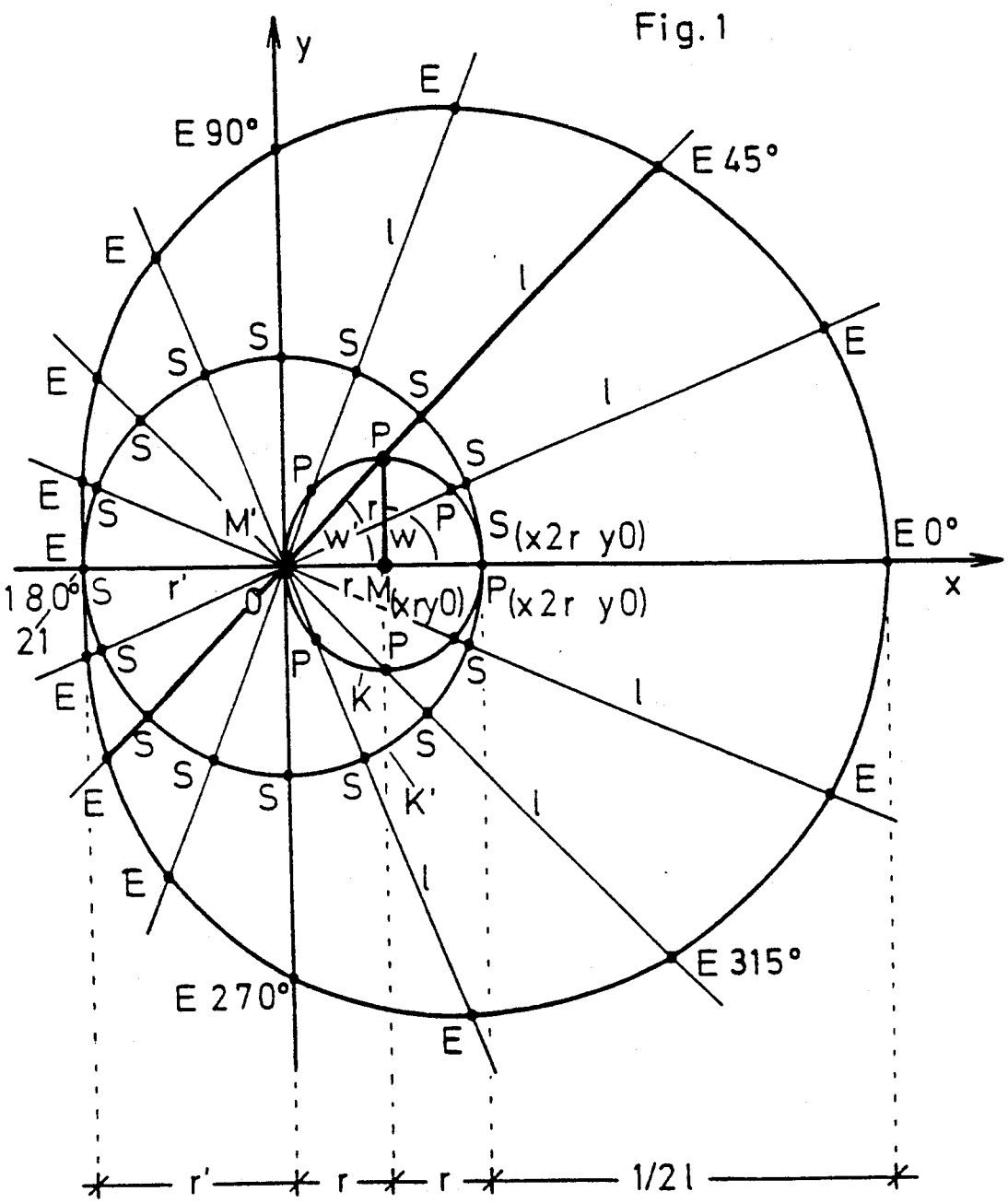
FIGS. 1 and 2 show the Pascalian Screw in cartesian and polar coordinates.

The rotary slide vane machine based on the geometric principle of the Pascalian Screw according to the present invention is primarily characterized by:

a housing with a hollow cylinder having an inner contour corresponding to the Pascalian screw and housing end pieces:

a rotary piston in the form of a hollow circular cylinder having a side wall with an inner mantle surface, the rotary piston rotatably supported at the housing end pieces and having an axis of rotation that is arranged axially with respect to the hollow cylinder and located within the zero point M' of the coordinates of the Pascalian screw, the rotary piston further having diametrically opposed longitudinal grooves;

a control shaft arranged inside the rotary piston and rotatably supported at the housing end pieces, the control shaft having an axis of rotation that is arranged axially with respect to the hollow cylinder and located within the center M of the base circle of the Pascalian screw, and having eccentric segments;

slide vanes guided within the diametrically opposed grooves of the rotary piston and having a length L, each slide vane comprised of stays and wings;

bearing bushings, connected to the stays of the slide vanes, rotatably guided on the eccentric segments with the eccentricity of the radius of the base circle and having flanges, with the wings being connected with the stays to the flanges of the bearing bushings;

the length L of the slide vanes determined according to the following equation:

$$L=6D+2r_{8s}+2d_{61}+2e+2s,$$

wherein

D is the diameter of the base circle, $r_{8s}$ is the radius of the eccentric segments, $d_{61}$ is the wall thickness of the bearing sleeves, e is the minimal displacement of the wing into the side wall of the rotary piston, and s is the minimal distance between the bearing sleeve and machine parts moving relative thereto;

a contour of the flange limited by an arc having the minimal distance s to the inner mantle surface of the rotary piston and by a lateral minimal distance $S'E'_{min}$ of one of the wings to an inner edge E' of a neighboring one of the wings which is determined by the following equation:

$$S'E'_{min}=M'E'_{180°}\cdot\sin\beta-(\tfrac{1}{2}\cdot d_{6f}\cos\beta+\tfrac{1}{2}\cdot d_{6f}+s),$$

wherein $M'E'_{180°}$ is the distance from the zero point M' of the rotary piston to the inner edge E' of one of the wings in the position at 180°, $\beta$ is the angle of 180° divided by the number of the slide vanes and $d_{6f}$ is the thickness of the wing; and the contour of the flange further limited to the area within an arc Kb with the radius $r_{Kr}$, that leads through the coordinates E'90°, E'180°, and E'270°, minus the minimal distance s to the inner mantle surface of the rotary piston according to the following equation:

$$r_{Kb}-s=\frac{(D+r_{8s}+d_{61}+s)^2+(r_{8s}+d_{61}+s)^2}{2(r_{8s}+d_{61}+s)}-s.$$

DESCRIPTION OF PREFERRED EMBODIMENT

For the solution of the complex object of the present invention the geometric principles known from the prior art are not sufficient.

The machine geometry upon which the machines of the prior art are based is limited to the circumferential line of the Pascalian Screw in the representation in cartesian coordinates $$(x^2+y^2-Dx)^2=L^2/4\cdot(x^2+y^2)$$

and $E=D\cdot\cos(a)+L/2$.

The base circle diameter D and the slide vane length L are used in this context as arbitrarily selected constants.

From this equation it can be taken that in principle this conchoidal may be the geometric basis of a slide vane machine, however, it may not be deduced whether the required constructive dimensions of all machine parts are adjusted to one another.

The constants D and L in the aforementioned equation may be selected independent from one another to an arbitrary value for a certain curve. However, the curve and thus the technical applicability depends on the selection of these values. The isolated consideration of a single curve is insufficient for the construction of a slide vane machine, because with the selection of the values for D and L the course of the curve and the proportionality of D to $D_{Kr}$ may be influenced in a manner that determines the general technical applicability. Based on the presently known state of the art, when selecting from the mathematically infinite number of circumferential lines one single curve, even for an arbitrary selection of an applicable value for the slide vane machine with a control shaft in the form of a crankshaft and one or two slide vanes per working chamber, no statement may be made whether this curve is also suitable for the use of an eccentric shaft with a substantially greater number of slide vanes.

Figure 3:
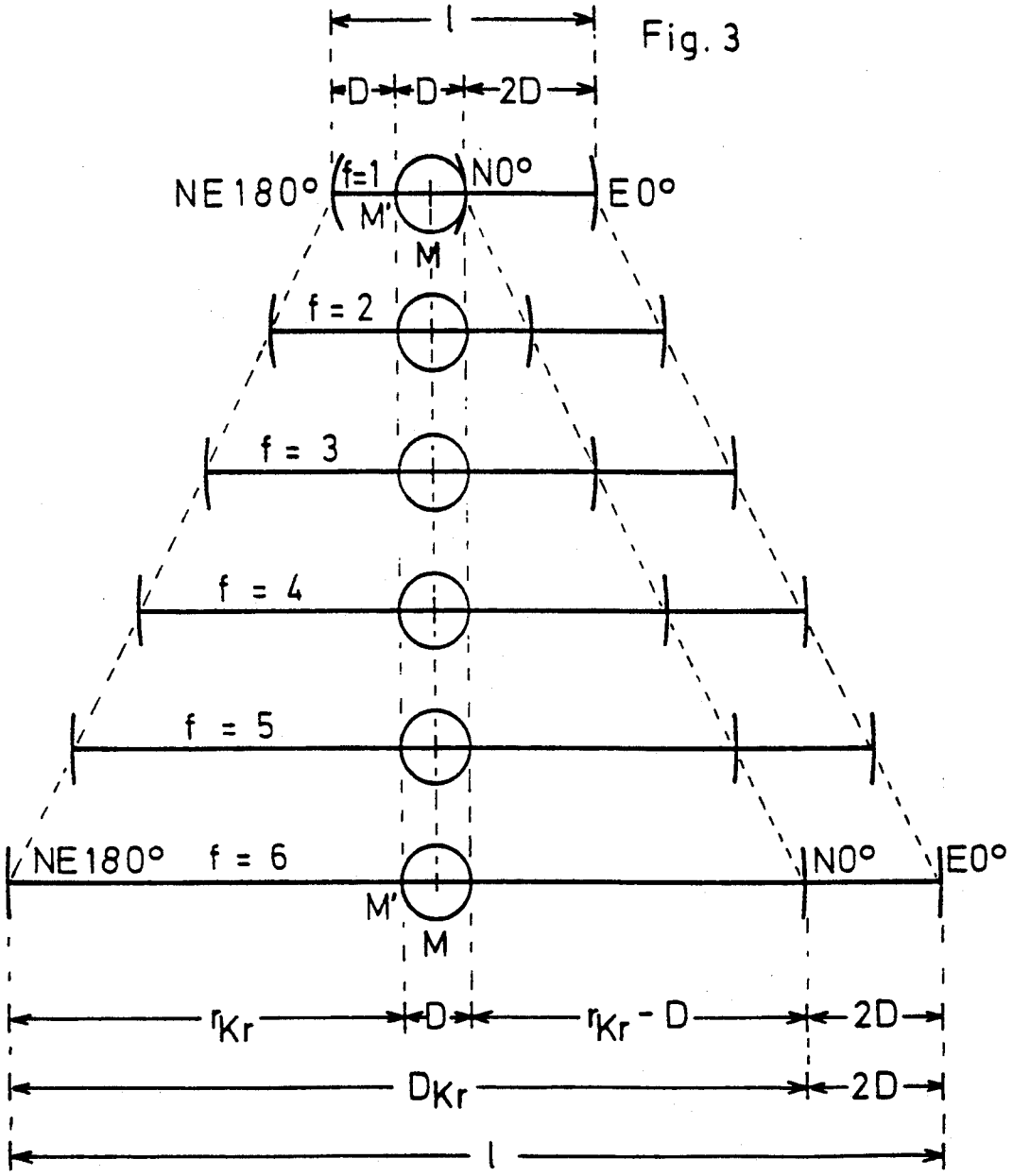
FIG. 3 shows a diagram of the representation of D as a function of 1.
Figure 4:
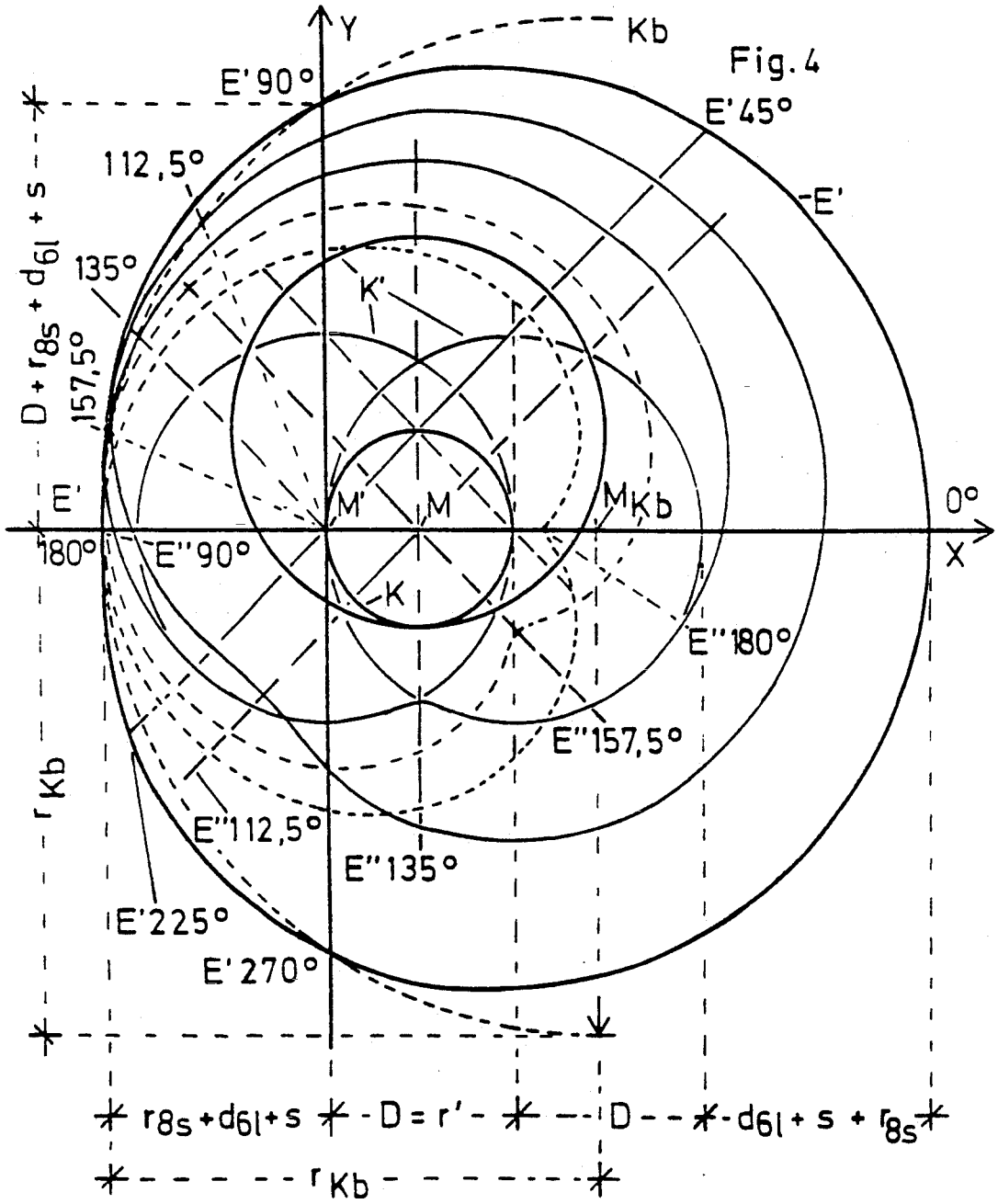
FIG. 4 shows the Pascalian Screw in the representation as a cardioid.

The first step to solving this problem is found in the consideration of all mathematically possible ratios of D to L for the construction by representing the constant D as a function of the other constant L. Accordingly the equation $$L=2D\cdot f+2D$$

results. This equation is diagrammatically represented in the drawing FIG. 3.

From it, it follows that the slide vane length L for an arbitrarily chosen value for the base circle diameter D may only be changed by changing the circular cylinder diameter $D_{Kr}(=2D\ f)$ by the factor f. The geometry of the control shaft 8 and thus of the slide vane maximum stroke $NE_{max}$ (=2D) remain constant. The proportionality factor f is an auxiliary factor. With it, the sum of all factors influencing the proportionality of D and L are combined. It serves to determine the limiting values for the proportions of the rotary piston diameter $D_{Kr}$ to the maximum stroke or displacement $NE_{max}$ for the individual construction designs and deduced from it the specific displacement volume:

For a usable machine geometry according to the Pascalian Screw, f must be greater or equal to 1, while even in the simplest construction of a slide vane machine with only one slide vane per working chamber the circular cylinder diameter $D_{Kr} > NE_{max} > L/2$.

When a plurality of slide vanes per working chamber is used, f must be greater or equal to 2 because the rotary cylinder diameter must be $D_{Kr} > NE_{max} > 2 \cdot 2D$. Thus the basic equation for slide vane machines with more than one slide vane per working chamber must be $$L = 2D \cdot 2 + 2D = 4D + 2D.$$

Figure 5:
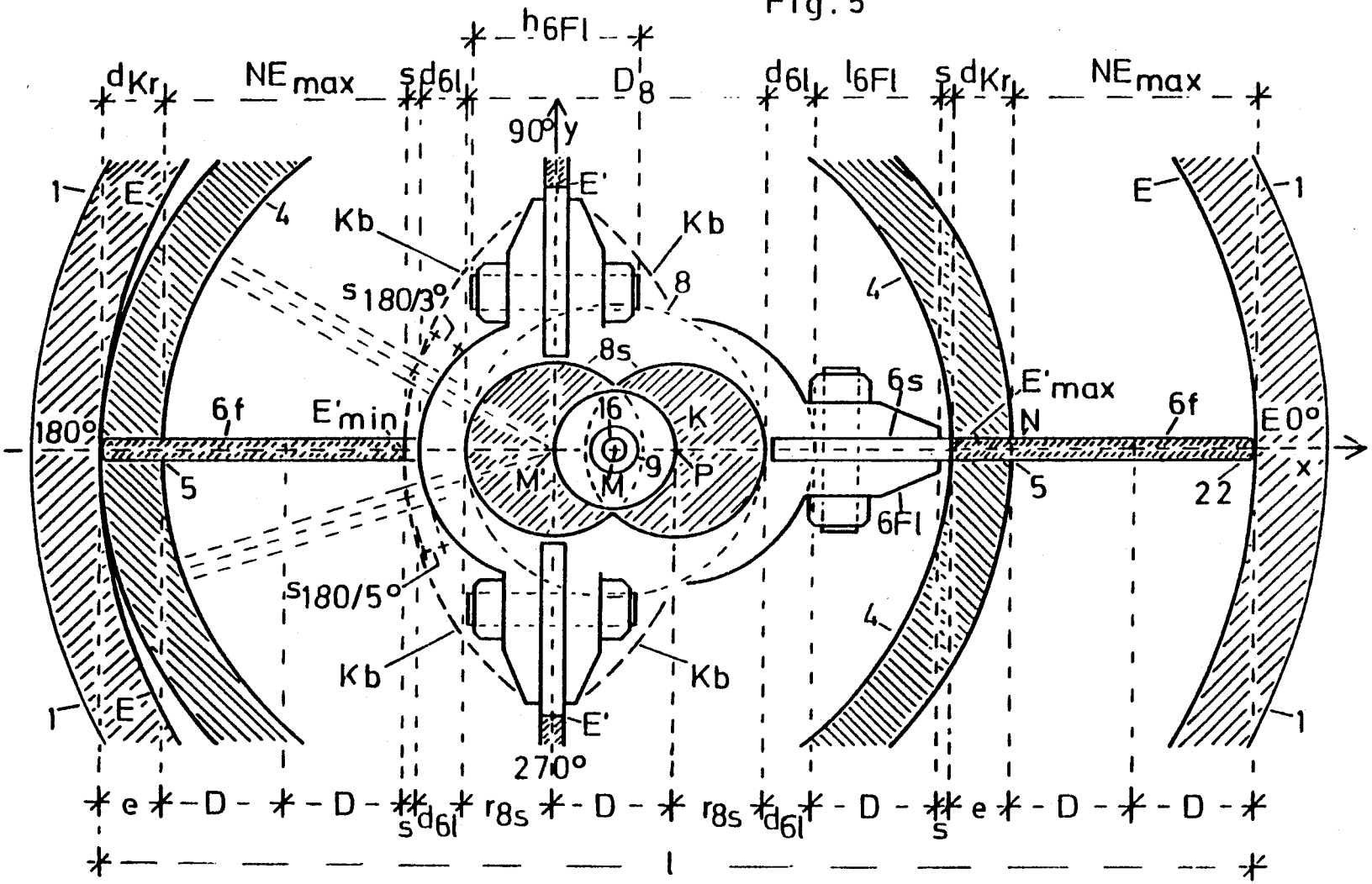
FIG. 5 shows the calculation rule for the proportion of the slide vane length.

From this equation the calculation rule represented in drawing FIG. 5 for the determination of the proportion of the control shaft, the slide vane bearings, the slide vane wing length and the rotary piston to the total length of the slide vane may be deduced by expanding it by the diameters respectively length of the aforementioned machine parts in the following manner:

$$D_{Kr} = 2D \cdot f = 2\,(2D + r_{8s} + d_{61} + s + e)$$

It follows $$f = \frac{2D + r_{8s} + d_{61} + s + e}{D}$$

and $$L = 4D + (d_{61} + D_{8s} + d_{61}) + 2s + 2e + 2D$$

wherein $r_{8s}$ = control shaft eccentric radius, $D_{8s}$ = control shaft eccentric diameter, $d_{61}$ = thickness of the slide vane bearing sleeve 61, s = minimal distance of the machine parts, e = minimal stroke of the slide vane within the circular cylinder side wall $d_{Kr}$.

The above calculation rule is also valid for machines with only one slide vane per working chamber. When such machines are adjusted with this rule, they may be expanded to a greater number of slide vanes without changing the proportions.

When $D_{8s} < D$ is selected, the control shaft 8 may only be constructed as a crank shaft. When selecting a value for $D_{8s} > D$ and $f > 2.5$, the control shaft becomes an eccentric shaft. The selection of the eccentric diameter for the undivided control shaft depends on the desired bending or torsion stiffness, i.e., the desired load capacity, and the diameter $D_{16}$ of the central longitudinal slotted bore 16. If it is desired to embody the control shaft, represented in FIG. 5, as a divided eccentric shaft with a central guide shaft 9 and eccentric 8*s* attached thereto, the value for $D_{8s}$ must be expanded by $D_9$–$D_{16}$ ($D_9$ being the diameter of the guide shaft 9).

The thickness $d_{61}$ of the slide vane bearing sleeve 61 depends, besides the required stiffness primarily on the selected type of bearing. Accordingly, the diameter of needle and ball bearings relative to friction bearings increases substantially and therefore requires a higher value for $d_{61}$.

The factor e corresponds to the minimal displacement of the slide vane within the circular cylinder side wall $d_{Kr}$ in the position of the maximum displacement relative to the circular cylinder at 0°. With e=0 the inner edge E' of the slide vane wing 6*f* would be congruent in its cross-section with the outer surface of the circular cylinder side wall. In practice, however, a value for the minimum displacement will be chosen that corresponds to $e > 0 < d_{Kr}$.

A plurality of slide vanes may only be positioned on a common control shaft when they are divided between the stays 6*s* and the bearing sleeve 61. The bearing sleeve 61 is divided into two halves in the plane of the slide vane in a symmetrical fashion and on both sides at the dividing plane is provided with a flange 6F1 which, with the cooperating flange of the other half, forms a groove (see FIG. 5).

Into this groove the plate-shaped stay 6*s* is inserted from the outside and connected to the flange of each half of the bearing sleeve with a bolt or a fitted screw. The described bearing design may also be used in an undivided form for needle and roller bearings.

The constructive dimension $\mathbf{1}_{6F1}$ that is available for the flange depends on the size of the minimal displacement e. When $e > d_{Kr}$, $\mathbf{1}_{6F1}$ may be selected to D. When reducing e to $e < d_{Kr}$, $\mathbf{1}_{6F1}$ is reduced by the value $d_{Kr} - e$. Due to the curvature of the circular cylinder side wall the constructive height $h_{6F1}$ of the bearing sleeve flanges in the position 0° is limited by the arc $r_{Kr} - (d_{Kr} + s)$.

The value s represents the minimal distance between the individual unconnected and movable components in the rotary piston. At the 0° position the slide vanes are displaced by the maximum value relative to the circular cylinder 4. In this position the bearing sleeve flange 6F1 has its shortest distance relative to the inner mantle surface of the circular cylinder side wall. Simultaneously, the inner edge E' of the slide vane wing 6*f* is at its minimal distance relative to the bearing sleeve of the oppositely arranged slide vane. This minimal distance, as is shown in drawings FIGS. 5–8, is slightly greater for an uneven number of slide vanes than for an even number of slide vanes. Accordingly, a slightly greater constructive space B for the bearing sleeves results.

The value s is primarily determined by the shape of the slide vane bearing, especially by the shape of the flange of the bearing sleeve. A bulky construction increases the required floating position of the bearing and thus increases correspondingly the value for e. The ratio of the maximum stroke $NE_{max}$ to the diameter of the rotary piston $D_{Kr}$ is correspondingly decreased.

Figure 2:
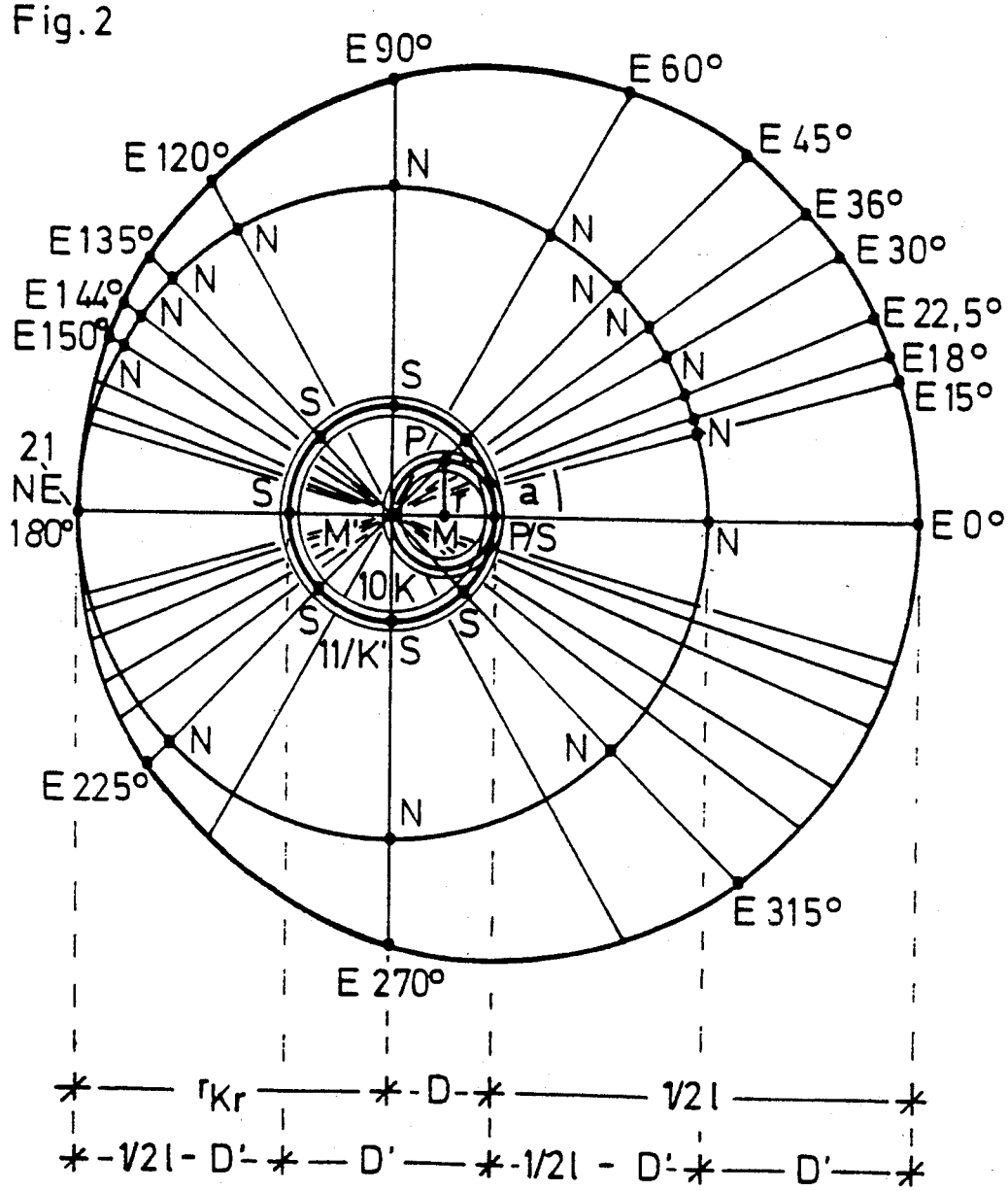

The maximization of this ratio without the simultaneous weakening of the control shaft respectively the slide vane bearing is thus possible only with the optimal usage of the constructive space and is the object of the following second portion of the calculation rule. As described above and disclosed on drawing FIG. 2, the following equation is valid for the Pascalian Screw:

$$E = D \cdot \cos(a) + L/2$$

(a) being the coordinate angle for a representation of the Pascalian screw in polar coordinates.

The inner edge E' of the slide vane wing 6*f* also follows a circumferential line according to the following equation:

$$E' = D \cdot \cos(a) + (D + r_{8s} + d_{61}) + s$$

Figure 10:
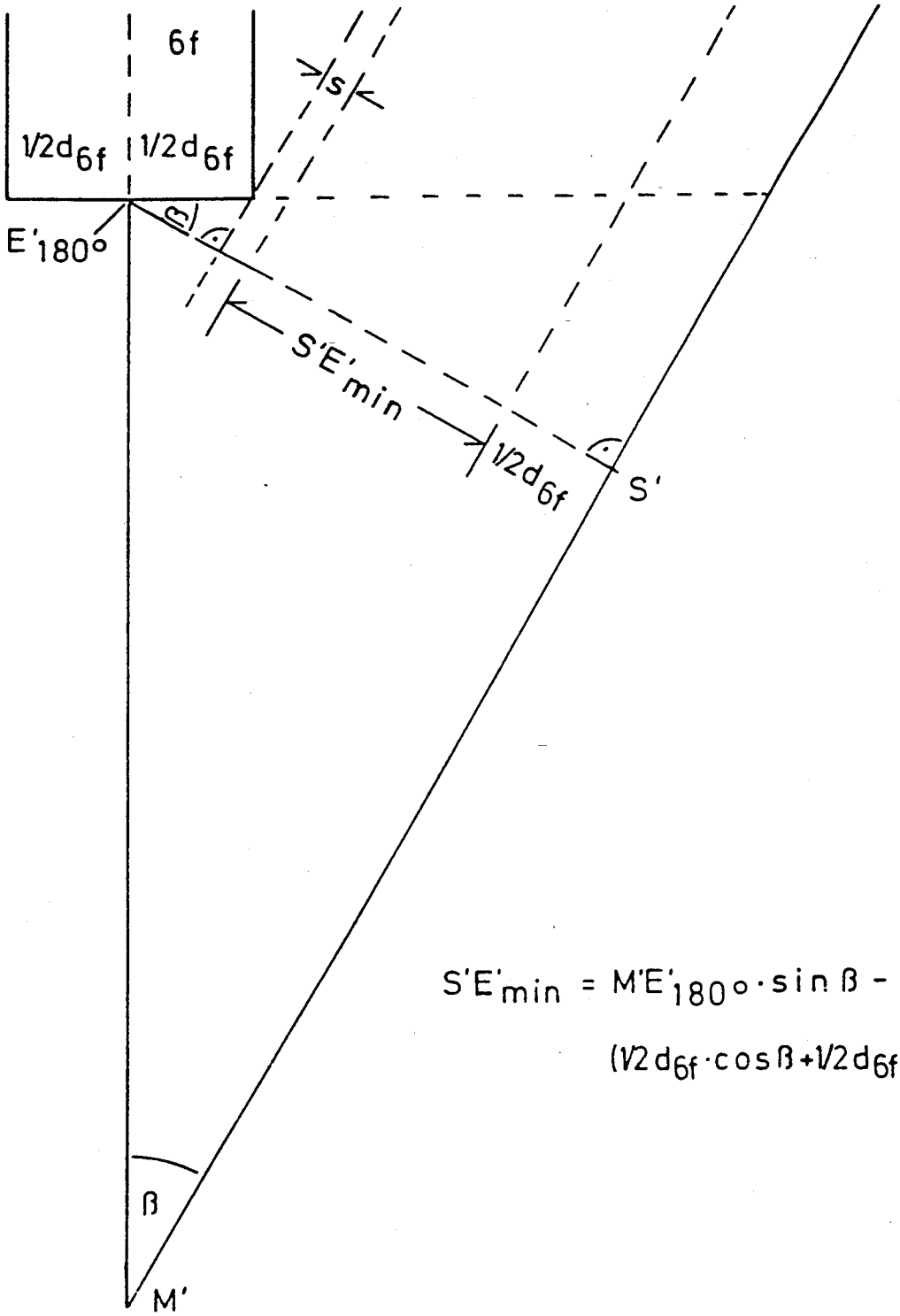
FIG. 10 illustrates in detail the lateral minimum distance $S'E'_{min}$.

From this a partial value for height $h_{6F1}$ of the flange of the bearing sleeve may be derived. It is determined by the lateral minimum distance S'E' of a slide vane 6 from the inner edge E' of a neighboring slide vane wing 6f and is expressed in the following equation which is represented in drawing FIGS. 7 and 10:

$$S'E_{min}' = M'E_{(180°)}' \cdot \sin\beta - (\tfrac{1}{2}\, d_{6f} \cdot \cos\beta + \tfrac{1}{2}\, d_{6f} + s),$$

wherein $d_{6f}$=thickness of the slide vane, s=minimal distance of the machine parts, n=number of slide vane, $\beta$=180/n°, the angle between two neighboring slide vanes.

For the bearing sleeve flange 6F1 a further, very important constructive space is available.

As can be taken from drawing 4, the conchoidal of the circle may also be understood as a cardioid, a special form of an epicycloid, whereby the center circle K' with its inner side rolls on the outer side of the base circle K and the extension points E, respectively, E' describe the cardioid.

The curve with the shortest technically unable extension of the center circle K' by r'=D, according to the equation L=2D·f+2D to the factor f=1.

According to the first part of the calculation rule, the cardioid of the points E with the rotary piston diameter is extended by $$r_{Kr}=2D+r_{8s}+d_{61}+e+s$$

and the cardioid E' is extended by the value ($r_{8s}+d_{61}+s$). The cardioids have the same position relative to the coordinate system of the conchoidal of the circle K when their apex lies on the x-axis of the cartesian coordinates, respectively, 0° in the polar coordinate system, and the return point is 0=M'.

Drawing 4 shows an arc Kb extending through the points E'90°, E'180°, and E'270° having a radius corresponding to the following equation:

$$r_{Kb} - s = \frac{(D + r_{8s} + d_{61} + s)^2 + (r_{8s} + d_{61} + s)^2}{2(r_{8s} + d_{61} + s)}$$

When from the extension E'0° of the center circle K' located on the return point at 0=M' angles between 90° and 180° with the apex at 0=M' are formed, the intersections of the free legs with the arc Kb during the rolling of the center circle K' about the base circle K create extended cardioids which contact the greatest cardioid leading through E'90° at one point, but do not intersect and are rotated by the doubled angular value about the center M of the base circle K.

This geometric relation is of great practical importance for the construction of the slide vanes, because the area within the arc with the radius $r_{Kb}$-s, in addition to the aforementioned height, may be used as the constructive space for the bearing sleeve flange 6F1. This constructive space becomes more and more important with an increasing number of slide vanes.

The individual parts of the bearing sleeve flanges 6F1 during their rotation correspond to the respective cardioids by rotation about the center M.

The parts, when they are located with the arc with the radius $r_{Kr}$-s, may undercut the inner edges E' of the neighboring slide vane wings 6f. The degree of this undercut increases with the height of the flanges and the number of slide vanes.

Figure 6:
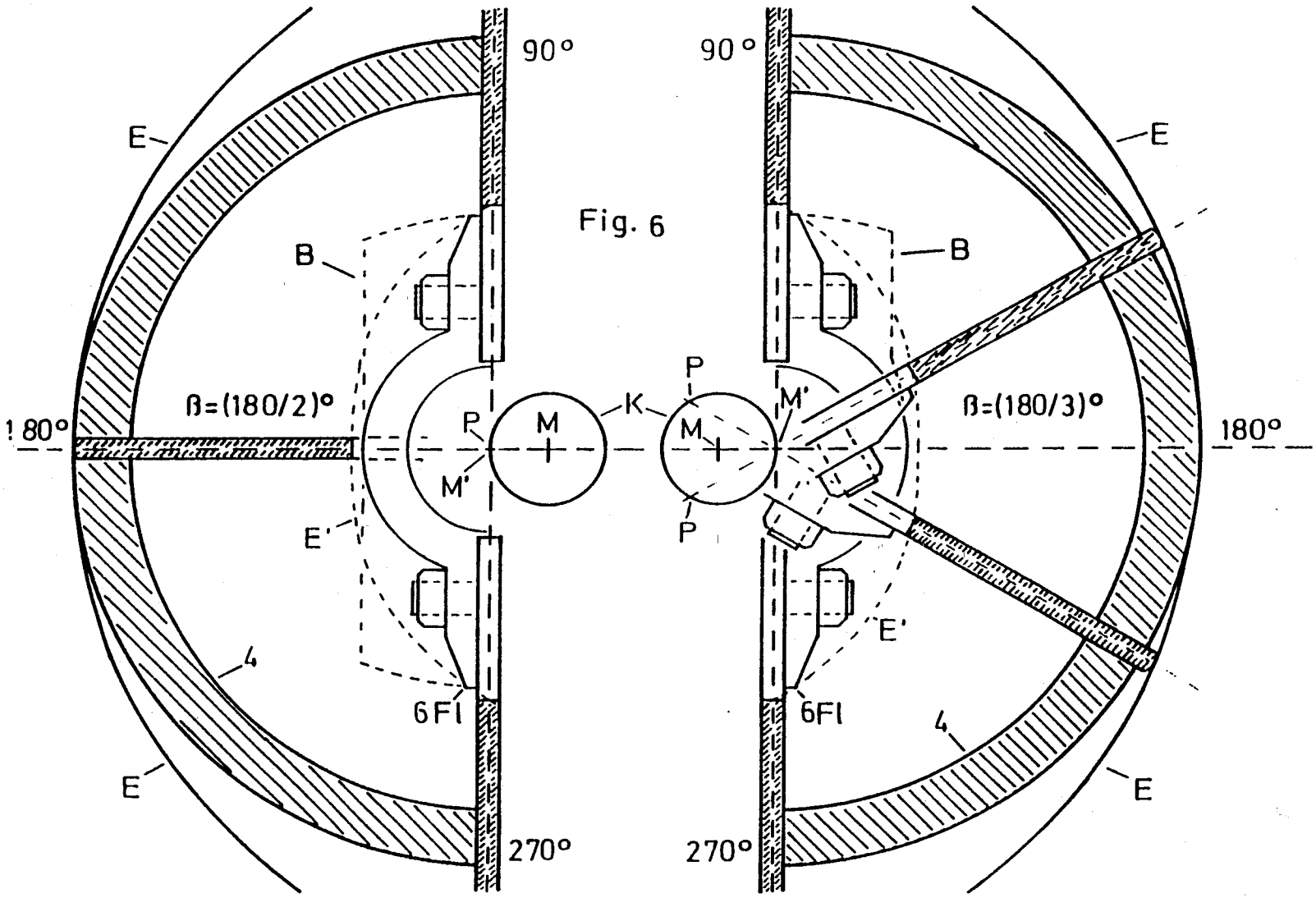
FIGS. 6, 7 and 8 show a portion of a slide vane machine in a cross-section for 2 to 7 slide vanes per working chamber.
Figure 7:
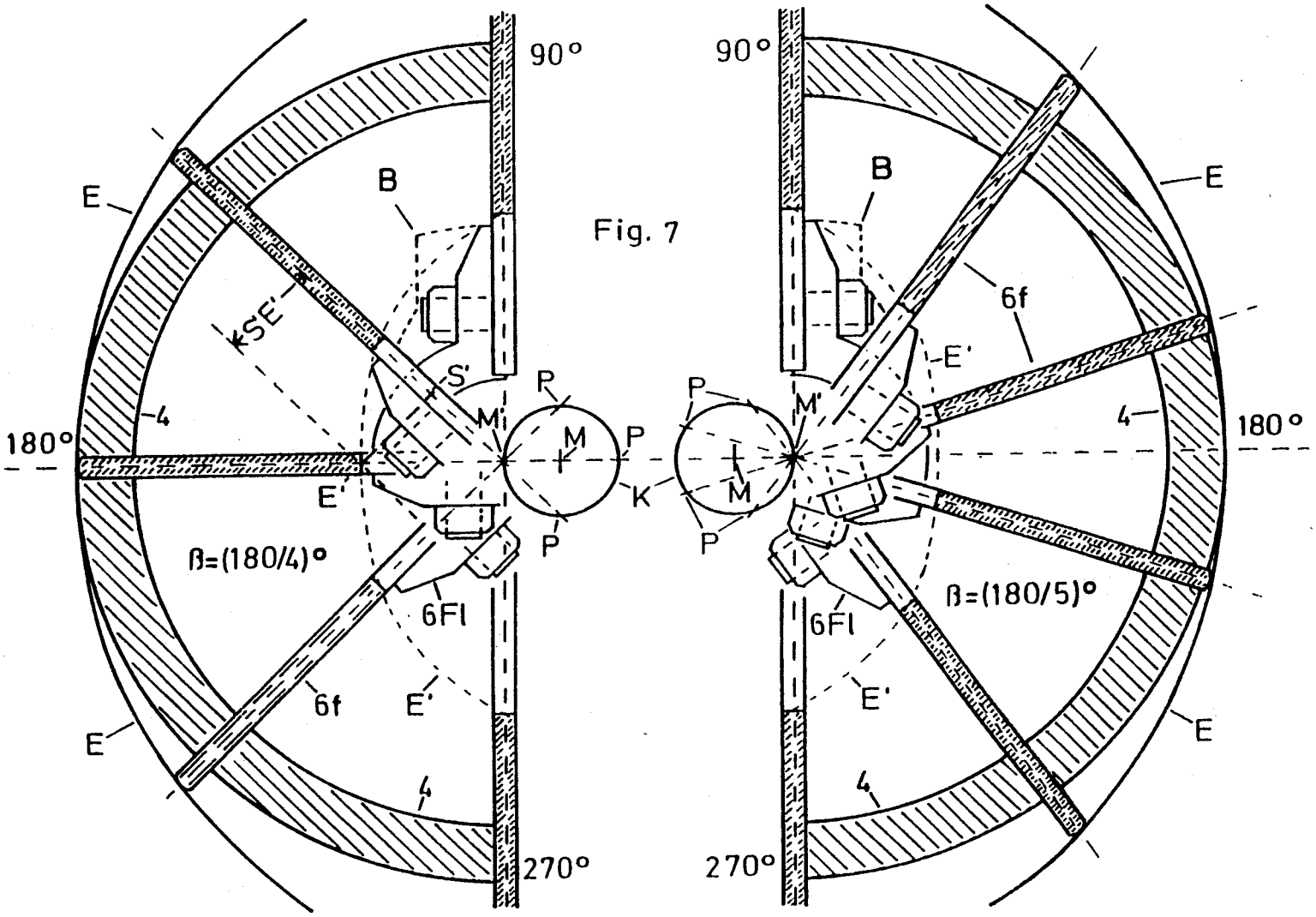
Figure 8:
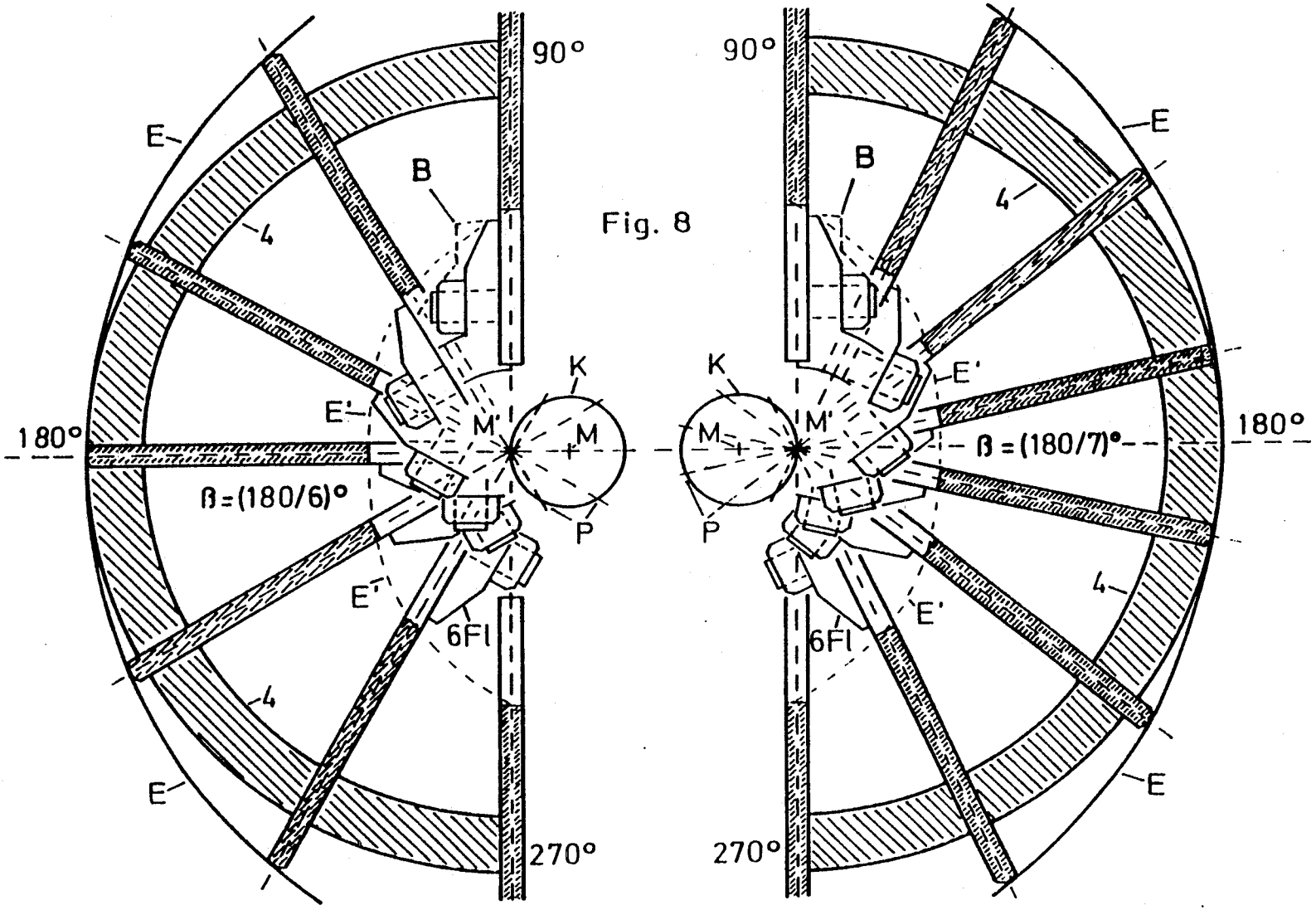
Figure 9:
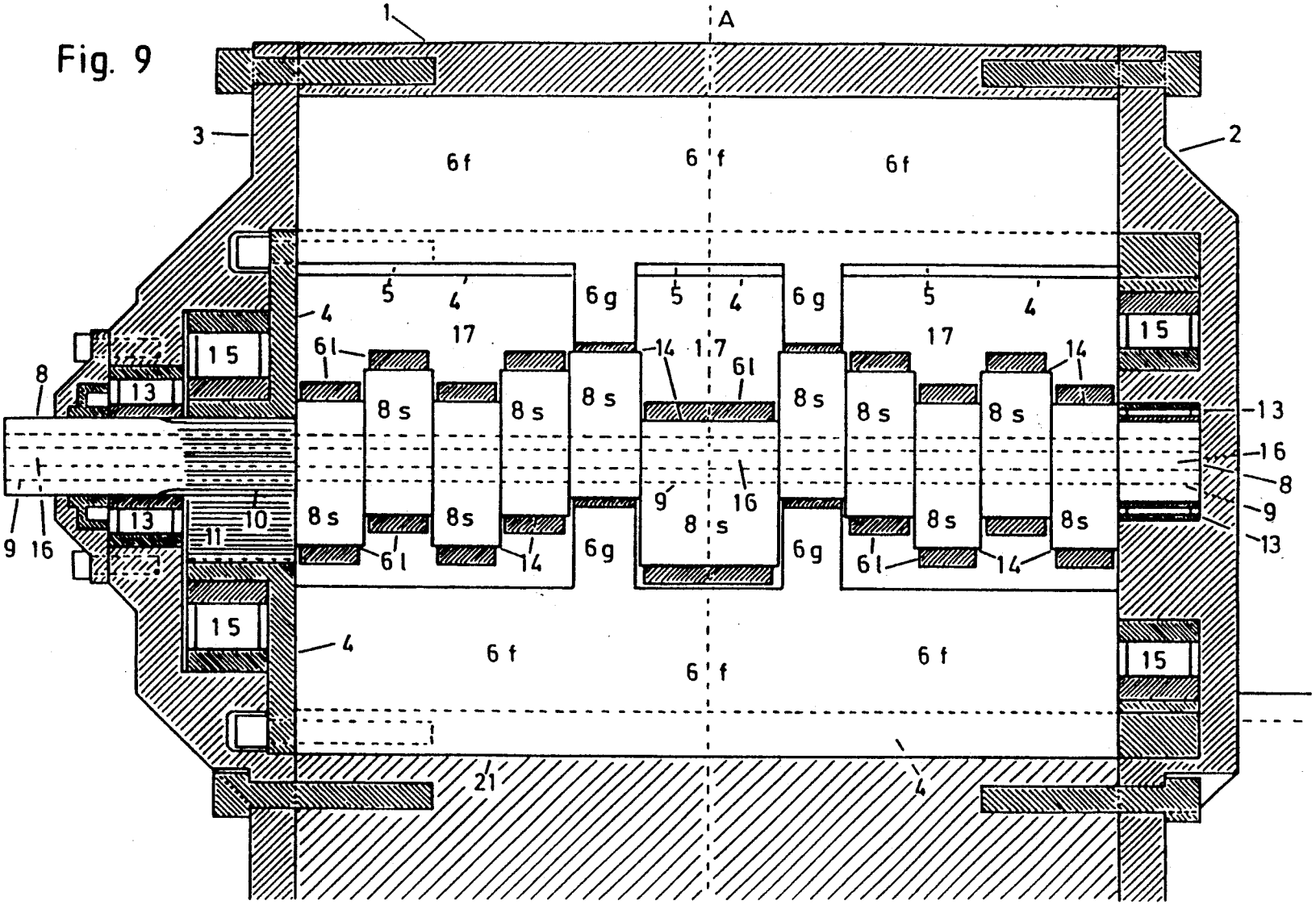
FIG. 9 shows an axial cross-section of a slide vane machine.

The drawings FIGS. 6–8 represent a cross-section of the slide vane profile with 2–7 slide vanes per working chamber. The shape of the flange for a constant size is selected such that it is still suitable for the highest number of slide vanes. In the respective 90° position the limiting lines of the maximum constructive space available is projected onto the contour of the flange. The constructive space decreases with an increasing number of slide vanes.

Only when the profile of the slide vane bearing is limited to the described construction space, the value for s may be minimized to a narrow slot.

The present invention is, of course, in no way restricted to the specific disclosure of the specification and drawings, but also encompasses any modifications within the scope of the appended claims.

I claim:

1. A rotary slide vane machine based on the geometric principle of the Pascalian screw, said rotary slide vane machine comprising:

a housing with a hollow cylinder having an inner contour corresponding to the Pascalian screw and housing end pieces;

a rotary piston in the form of a hollow circular cylinder having a side wall with an inner mantle surface, said rotary piston rotatably supported at said housing end pieces and having an axis of rotation that is arranged axially with respect to said hollow cylinder and located within the zero point M' of the coordinates of the Pascalian screw, said rotary piston further having diametrically opposed longitudinal grooves;

a control shaft arranged inside said rotary piston and rotatably supported at said housing end pieces, said control shaft having an axis of rotation that is arranged axially with respect to said hollow cylinder and located within the center M of a base circle of the Pascalian screw, and having eccentric segments;

slide vanes guided within said diametrically opposed grooves of said rotary piston and having a length L, each said slide vane comprised of stays and wings;

bearing bushings, connected to said stays of said slide vanes, rotatably guided on said eccentric segments with the eccentricity of the radius of said base circle and having flanges, with said wings being connected with said stays to said flanges of said bearing bushings;

said length L of said slide vanes determined according to the following equation:

$$L=6D+2r_{8s}+2d_{61}+2e+2s,$$

wherein

D is the diameter of said base circle, $r_{8s}$ is the radius of said eccentric segments, $d_{61}$ is the wall thickness of said bearing sleeves, e is the minimal displacement of said wing into said side wall of said rotary piston, and s is the minimal distance between said bearing sleeve and machine parts moving relative thereto;

a contour of said flange limited by an arc having said minimal distance s to said inner mantle surface of said rotary piston and by a lateral minimal distance $S'E'_{min}$ of one of said wings to an inner edge E' of a neighboring one of said wings which is determined by the following equation:

$$S'E'_{min}=M'E'_{180°}\cdot\sin\beta-(\tfrac{1}{2}\cdot d_{6f}\cos\beta+\tfrac{1}{2}\cdot d_{6f}+s),$$

wherein $M'E'_{180°}$ is the distance from said zero point M' of said rotary piston to the inner edge E' of one of said wings in the position at 180° corresponding to minimum wing extension from the rotary piston, $\beta$ is the angle of 180° divided by the number of said slide vanes, and $d_{6f}$ is the thickness of said wing; and said contour of said flange further limited to the area within an arc Kb with a radius $r_{Kb}$, that leads through housing coordinates E'90°, E'180°, and E'270°, minus said minimal distance s to said inner mantle surface of said rotary piston according to the following equation:

$$r_{Kb} - s = \frac{(D + r_{8s} + d_{61} + s)^2 + (r_{8s} + d_{61} + s)^2}{2(r_{8s} + d_{61} + s)} - s.$$

* * * * *